US006578238B2

(12) United States Patent
Bettinger

(10) Patent No.: US 6,578,238 B2
(45) Date of Patent: Jun. 17, 2003

(54) APPARATUS FOR DEPOSITING SLIVER IN A FLAT COILER CAN AND METHOD

(75) Inventor: Detlef Bettinger, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 10/116,119

(22) Filed: Apr. 5, 2002

(65) Prior Publication Data

US 2002/0152586 A1 Oct. 24, 2002

(30) Foreign Application Priority Data

Apr. 5, 2001 (DE) ..... 101 16 944

(51) Int. Cl.[7] ..... D04H 11/00
(52) U.S. Cl. ..... 19/159 R; 19/65 A; 19/159 A
(58) Field of Search ..... 19/65 A, 65 R, 19/98, 150, 157, 159 A, 159 R, 236

(56) References Cited

U.S. PATENT DOCUMENTS

| | | | | |
|---|---|---|---|---|
| 3,703,023 A | * | 11/1972 | Krauss et al. | 19/240 |
| 5,428,869 A | | 7/1995 | Holubec et al. | |
| 5,621,948 A | | 4/1997 | Hartung | |
| 5,664,398 A | * | 9/1997 | Leifeld | 53/118 |
| 5,815,889 A | * | 10/1998 | Barth et al. | 19/240 |
| 6,273,314 B1 | * | 8/2001 | Promoli | 226/118.1 |
| 6,286,188 B1 | * | 9/2001 | Muller et al. | 19/239 |

FOREIGN PATENT DOCUMENTS

| | | |
|---|---|---|
| DE | 28 45 881 | 4/1980 |
| DE | 43 33 730 | 4/1994 |
| DE | 43 33 731 | 4/1994 |
| DE | 44 07 110 | 11/1994 |
| DE | 37 34 425 | 3/1995 |
| DE | 195 48 232 | 9/1996 |

OTHER PUBLICATIONS

Prospectus, "Carda Per Cotone mod. C.20", F.Ili Marzoli & C.—S.p.A., 4 pages.

* cited by examiner

*Primary Examiner*—Gary L. Welch
(74) *Attorney, Agent, or Firm*—Venable LLP; Robert Kinberg; Stuart I. Smith

(57) ABSTRACT

A carding machine in combination with an apparatus for charging a flat coiler can with sliver. The apparatus is disposed at the outlet of the carding machine and includes a rotary coiler head receiving sliver from the carding machine outlet and depositing the sliver in coils in the coiler can. The coiler can is reciprocated underneath the coiler head in a first direction for depositing sliver along a coiler can length extending parallel to the first direction. When charging of the coiler can is concluded, a device shifts the coiler head in a second direction over an additional coiler can for switching coiler cans from a full can to an empty can. A slack forming device for forming a slack in the sliver is arranged between the carding machine outlet and the coiler head.

11 Claims, 4 Drawing Sheets

APPARATUS FOR DEPOSITING SLIVER IN A FLAT COILER CAN AND METHOD

CROSS REFERENCE TO RELATED APPLICATION

This application claims the priority of German Application No. 101 16 944.2 filed Apr. 5, 2001, which is incorporated herein by reference.

BACKGROUND OF THE INVENTION

The invention relates to an apparatus arranged at the output end of a carding machine for charging a coiler can with outputted sliver. The coiler can is of the type that has a flat design, that is, it has an elongated horizontal outline. The sliver is deposited in coils in the can by a rotary coiler head, while the rotary head and the coiler can shift relatively to one another. When the desired fill level is reached in the can, the coiler head moves perpendicularly to the longitudinal can axis over an empty, standby can, and further, the filled can is replaced by an empty can which thus becomes the new standby can.

German patent document 43 33 730, to which corresponds U.S. Pat. No. 5,428,869, discloses an apparatus in which the sliver is advanced from a carding machine to a coiler can station and is introduced there in an oblique intake device of the coiler head. Simultaneously with the rotation of the coiler head, the coiler can supporting device executes a linear back-and-forth motion with the coiler can with strokes parallel to, and equaling the horizontal can length.

Because of such a reciprocating motion during the sliver deposition, the sliver is disadvantageously exposed to an undesired, alternating pull. It is a further drawback that the coiler can switch (that is, the shift of the coiler head from above the filled coiler can over an empty coiler can) and the coiler can replacement (that is, the supply and removal of an empty and, respectively, a filled can to and from the coiler head) occur simultaneously. During such an occurrence the coiler head is, with the sliver, first shifted in one direction and subsequently in an opposite direction, whereby the sliver is exposed to an additional undesired draft. It is yet another disadvantage that such a conventional apparatus is of complex construction.

SUMMARY OF THE INVENTION

It is an object of the invention to provide an improved apparatus and method of the above-outlined type from which the discussed disadvantages are eliminated and which makes possible the deposition of a uniform sliver in a particularly simple manner.

This object and others to become apparent as the specification progresses, are accomplished by the invention, according to which, briefly stated, the apparatus for charging a flat coiler can with sliver is combined with a carding machine. The apparatus is disposed at the outlet of the carding machine and includes a rotary coiler head receiving sliver from the carding machine outlet and depositing the sliver in coils in the coiler can. The coiler can is reciprocated underneath the coiler head in a first direction for depositing sliver along a coiler can length extending parallel to the first direction. When charging of the coiler can is concluded, a device shifts the coiler head in a second direction over an additional coiler can for switching coiler cans from a full can to an empty can. A slack forming device for forming a slack in the sliver is arranged between the carding machine outlet and the coiler head.

By virtue of the sliver slack forming device, an undesired draft (tensioning) of the sliver is avoided or compensated for. Because coiler can switching and coiler can replacement occur consecutively, additional displacement effects on the sliver and thus undesired additional sliver tensioning is counteracted, and also, the coiler can replacement may occur parallel to the longitudinal axis of the cans.

DESCRIPTION OF THE PREFERRED EMBODIMENTS

Figure 1:
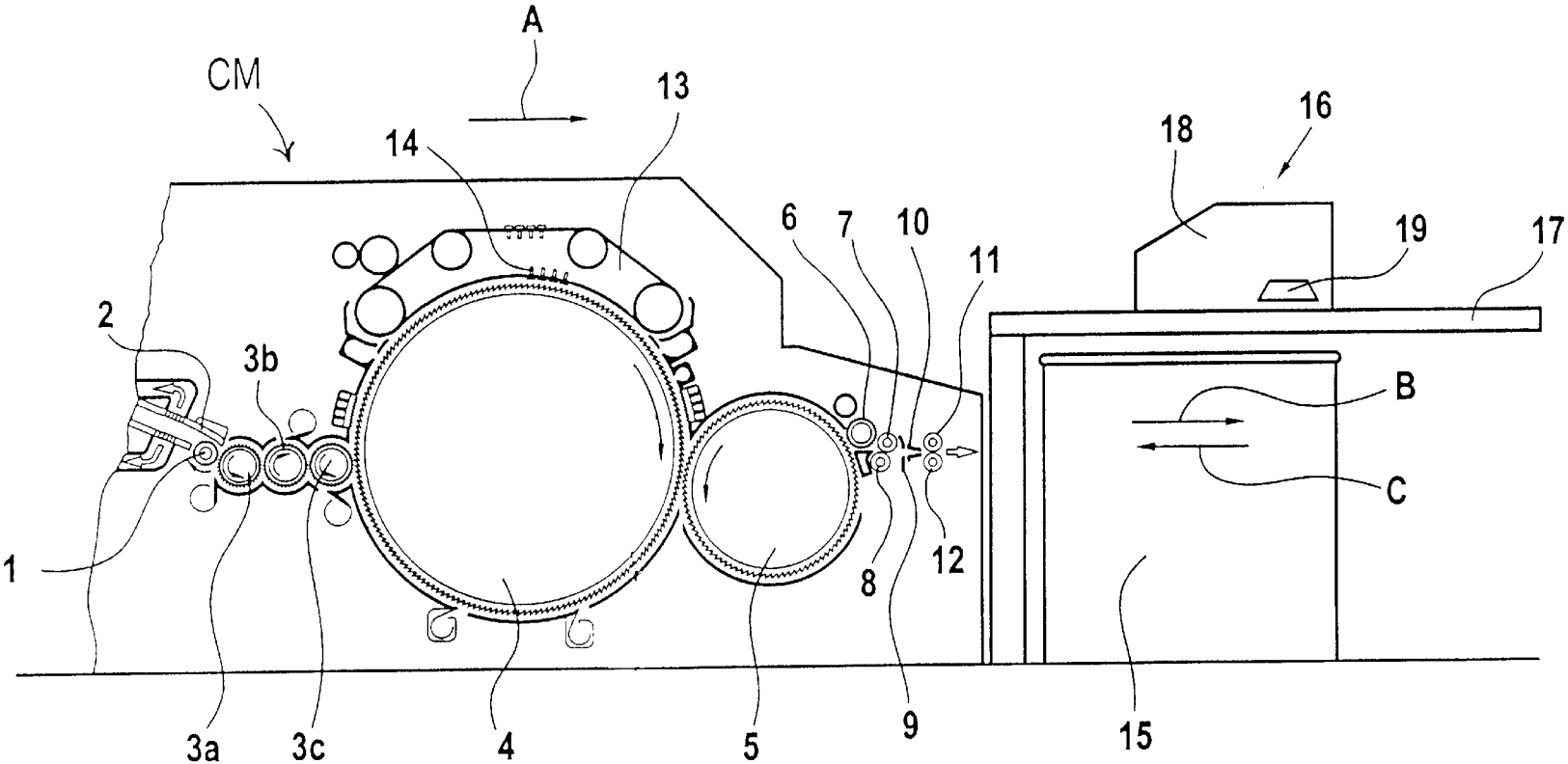
FIG. 1 is a schematic side elevational view of a carding machine adapted to incorporate the invention.

FIG. 1 illustrates a carding machine CM which may be, for example, a high-performance DK 903 model, manufactured by Trützschler GmbH & Co. KG, Mönchengladbach, Germany. The carding machine CM has a feed roller 1, a feed table 2 cooperating therewith, licker-ins 3*a*, 3*b* and 3*c*, a main carding cylinder 4, a doffer 5, a stripping roll 6, crushing rolls 7, 8, a web guiding element 9, a sliver trumpet 10, calender rolls 11, 12, a traveling flats assembly 13 having flat bars 14 and a coiler 16 for depositing sliver into a coiler can 15. The processing direction of the fiber material is designated at A. Above a cover plate 17 of the coiler 16 a housing 18 is disposed which accommodates a rotary coiler head 19 and an upstream-arranged, regulated sliver drafting unit 20 shown in FIG. 4. The coiler can 15 has a horizontally generally elongated, rectangular outline and is, while the coiler head 19 rotates and deposits sliver, reciprocated in the direction of arrows B and C by a non-illustrated, conventional mechanism.

Figure 2:
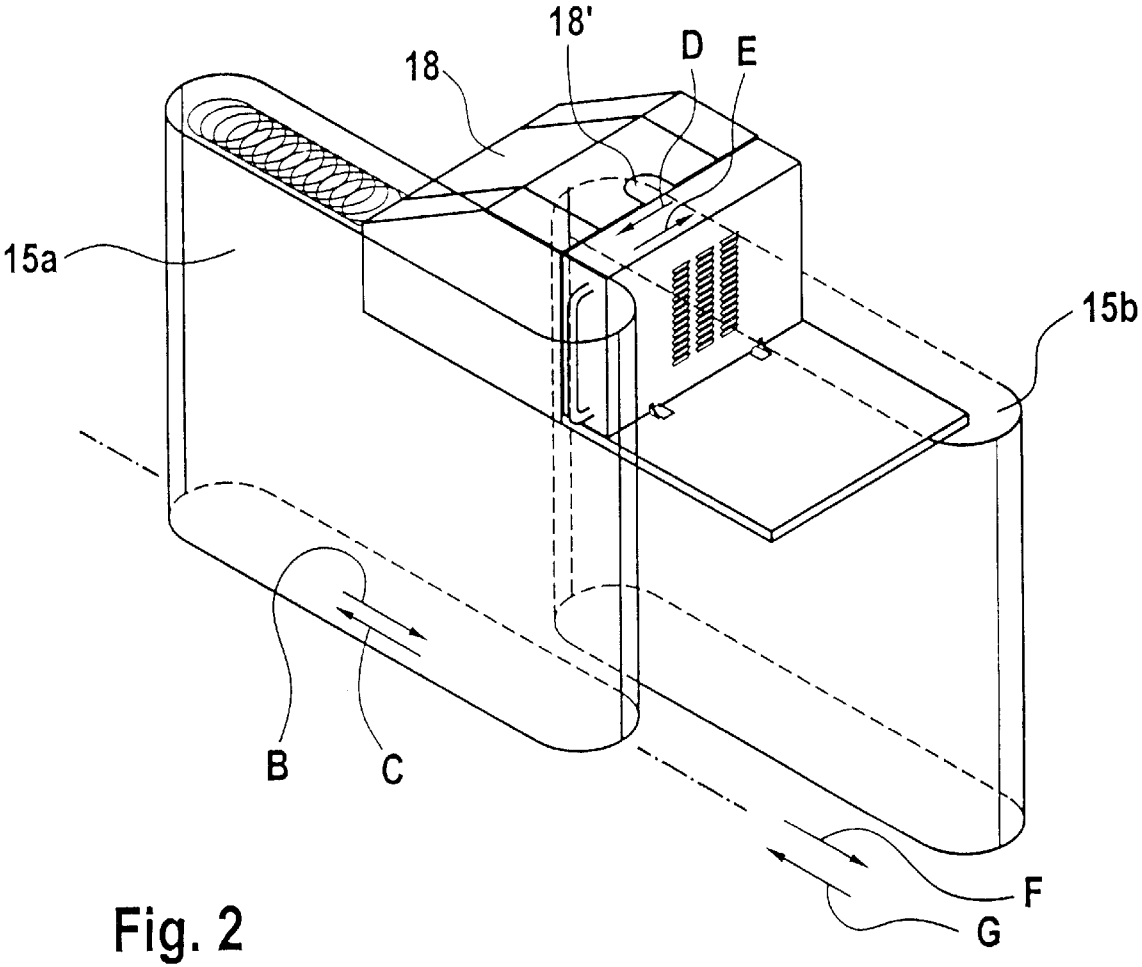
FIG. 2 is a schematic perspective view of a conventional apparatus showing movements of the coiler and the coiler cans.
Figure 5:
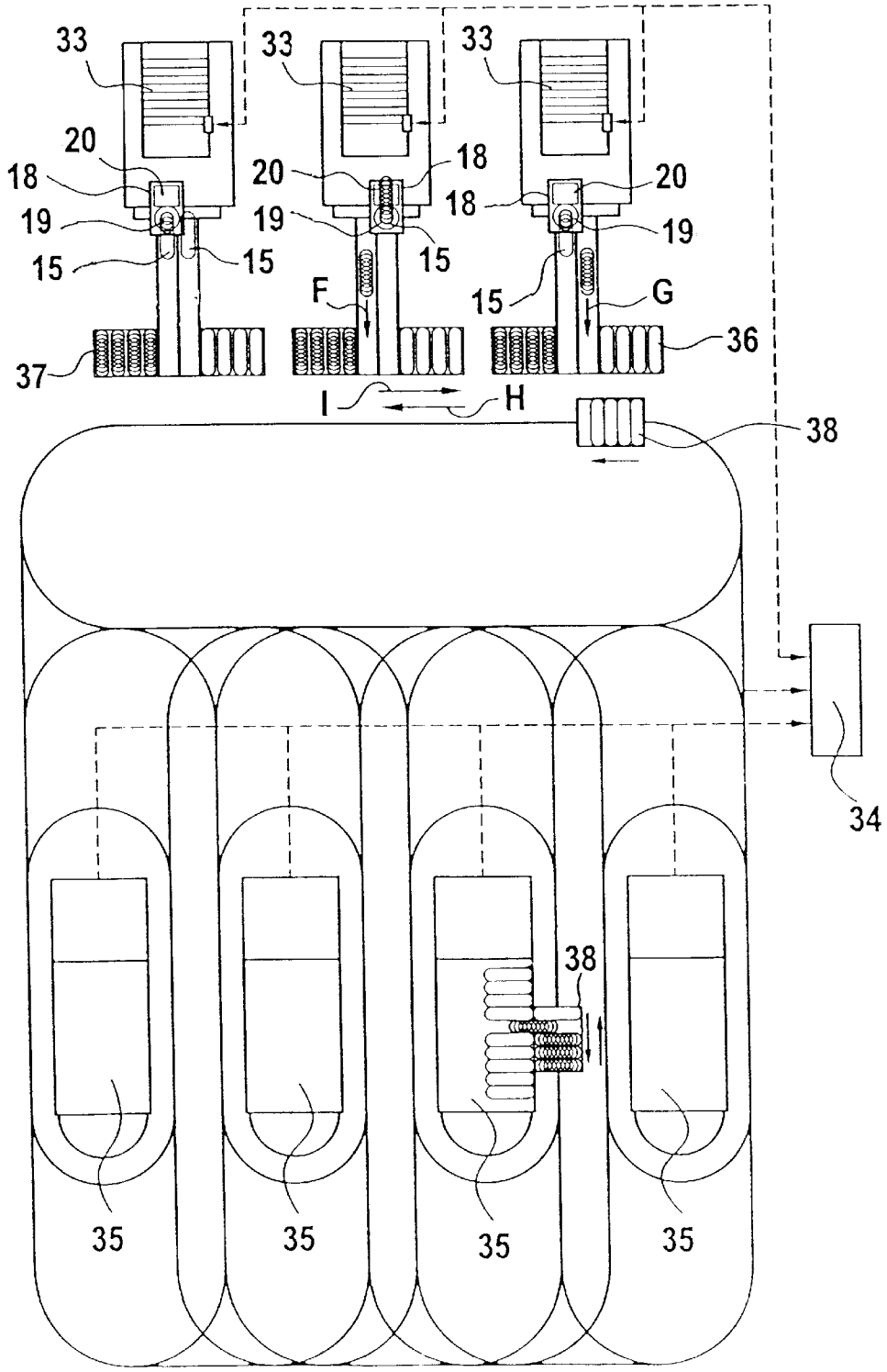
FIG. 5 is a schematic top plan view of a system including a plurality of carding machines, each associated with a sliver drafting unit, an apparatus for coiler can switching and replacement, a plurality of coiler can storing devices and a plurality of spinning machines.

FIG. 2 illustrates two side-by-side arranged coiler cans 15*a* (containing sliver) and 15*b* (empty). During the sliver filling process, the coiler can 15*a* is reciprocated as shown by the arrows B, C while the empty can 15*b* is stationary in a standby position. As soon as the coiler can 15*a* is filled with sliver (deposited in coils), the housing 18, together with the rotary head 19 (not visible in FIG. 2), is shifted in the direction of the arrow E from above the full can 15*a* to above the empty can 15*b* to thus perform the coiler can switching operation. The running sliver is severed during such a shifting motion. An apparatus to perform such sliver severing is disclosed, for example, in German Offenlegungsschrift (application published before examination) 195 48 232. The coiler head 19 continues to rotate during its shift in the direction E with unchanged circumferential velocity. Thereafter the filling process continues by charging the can 15*b* and upon completion of such charging, the shift of the coiler head 19 will occur in the direction D. After the coiler head 19 has assumed its position above the new, empty can 15*b* (that is, the coiler can switching step is terminated), and charging of the new can 15*b* is in progress, the full can 15*a* is moved away from the coiler head 19 and an empty can (not shown in FIG. 2) is moved in its place in the direction of arrows F or G in performance of the coiler can replacement step. As illustrated in FIG. 5, in the course of the coiler can replacement, an empty can is moved from an empty-can storage device 36 next to the can which is being charged, while the earlier filled can is moved to a full-can storage device 37.

Figure 3:
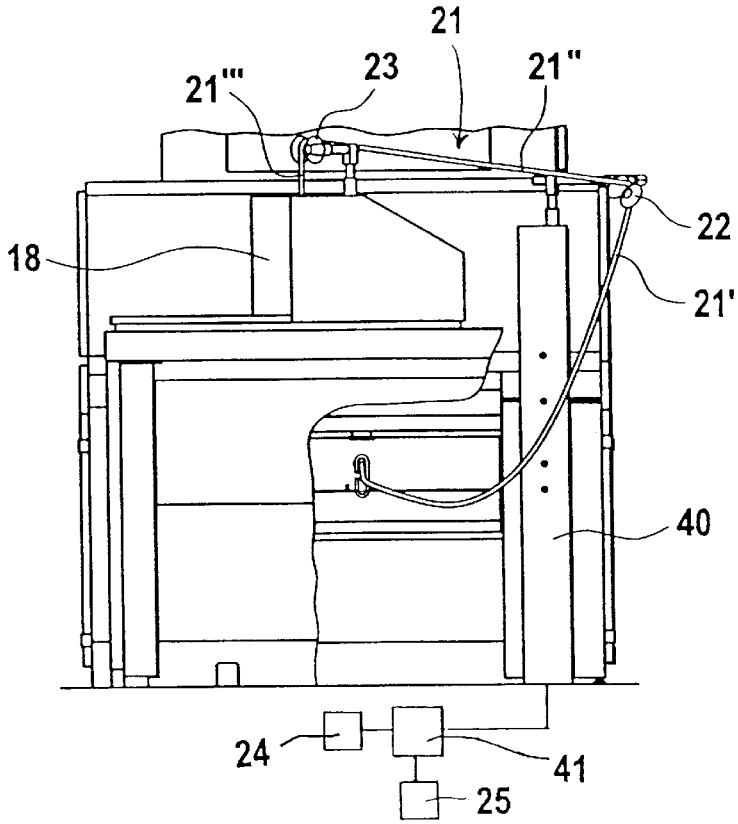
FIG. 3 is a schematic, broken-away, end elevational view of the carding machine, incorporating a preferred embodiment of the invention.
Figure 4:
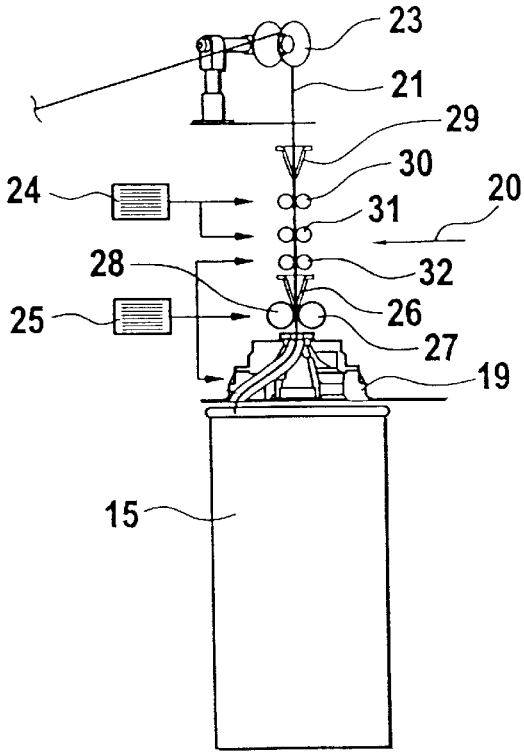
FIG. 4 is a schematic sectional elevational view of a sliver drafting unit, followed by a coiler head.

Turning to FIGS. 3 and 4, the running sliver 21 has a sliver length portion 21' between the outlet of the carding machine (represented by the calender rolls 11, 12 in FIG. 1) and a first sliver deflecting roller 22, a sliver length portion 21" between the sliver deflecting roller 22 and a second sliver deflecting roller 23, and a sliver length portion 21'" between the second sliver deflecting roller 23 and a passage 18' (shown in FIG. 2) leading into the inner space of the housing 18. The length portion 21' is a slack, loosely hanging part which constitutes a stored sliver portion. A sensor device for detecting the extent of slack of the sliver portion 21' is constituted by an optical barrier column 40 which is connected with the drive motors 24, 25 by an electronic control and regulating device 41. In this manner the extent of slack is adjusted and thus a length equalization is effected without changing the draft (tension) on the sliver 21 when velocity changes occur in the sliver drawing mechanism 20. Likewise, upon shifting the housing 18 with the coiler head 19 and the sliver drawing unit 20 in the direction of arrows D or E in the course of switching coiler cans, by virtue of the hanging sliver length portion 21' a length compensation is effected without exposing the sliver 21 to undesired draft changes.

Continuing to refer to FIG. 4, a sliver trumpet 26 is arranged above the coiler head 19, immediately followed by a pair of calender rolls 27, 28. Between the sliver trumpet 26 and the sliver deflecting roller 22 the sliver drafting unit 20 is arranged which includes, at its inlet, a measuring trumpet 29. An input drafting roll pair 30 and a center drafting roll pair 31 are driven by the regulated electric drive motor 24, whereas the output drafting roll pair 32, the calender rolls 27, 28 and the coiler head 19 are driven by a further electric drive motor 25.

Turning to FIG. 5, the apparatus according to the invention is utilized in a "direct spinning" system. The process for automating the yarn manufacturing steps is, particularly in spinning plants operating with rotary spinning machines, advantageously based on the utilization of coiler cans having a horizontally elongated (flat) cross-sectional outline. Such a coiler can 15 may be positioned on a selected working location and accurately oriented thereon by simple, conventional means. A flat coiler can 15 has further advantages: Because of a more efficient coverage of the floor surface and a more uniform layering of the sliver, flat coiler cans may be charged with about twice the sliver quantity as compared to coiler cans of circular horizontal cross-sectional outline.

The automatic yarn making process is controlled by a control center 34 which makes decisions concerning the replacement of coiler cans 15 underneath the rotary spinning machines 35. Such decision is based, for example, on the sum of two logic signals indicating that a predetermined spinning period at a spinning station has been reached or exceeded, so that in that spinning station the spinning process was interrupted. For optimizing the process of can replacement, the control center 34 utilizes the knowledge of data about a spinning period proper of the individual spinning stations from the time of the last can replacement at that spinning station. As filling stations for the cans 15, in the spinning plant at least one carding machine 33 is provided which has a sliver drafting unit 20 and a rotary coiler head 19. With each illustrated carding machine 33 a respective empty-can storage device 36 and a full-can storage device 37 are provided. Further, mechanizing means are provided for automatically removing the empty cans 15 from the laterally positioned empty-can storage device 36, for subsequently positioning, operating and filling them underneath the rotary head 19 and for thereafter depositing the full cans in the laterally positioned full-can storage device 37. The empty-can storage device 36 and the full-can storage device 37 are shiftable in the direction of the arrows H, I.

On the can storage devices of a conventional belt conveyor or roller conveyor type, the cans are shifted in such a manner that, for example, the filled flat cans are consecutively accumulated, with their longitudinal walls adjoining, until the desired number of the full cans is reached on the storage device 37. The filling station further has a suction device for removing sliver remnants and impurities from the empty cans and a non-illustrated device for the oriented attachment of a sliver end to a selected location in the vicinity of the upper edge of each full can.

On the floor surface of the spinning plant, between the rotary spinning machines 35 and at least one filling station for the cans 15 an induction loop is provided by means of which the signals from the control center 34 and the sensors are exchanged with at least one automatically controlled transport carriage 38 which has a pallet for the cans 15.

The housings 18, with their coiler heads 19 and drafting units 20, associated with the various respective carding machines 33 are shown in FIG. 5 in different positions, corresponding to the extent of the local shifts in the direction of the arrows D, E.

It will be understood that the above description of the present invention is susceptible to various modifications, changes and adaptations, and the same are intended to be comprehended within the meaning and range of equivalents of the appended claims.

What is claimed is:

1. In a carding machine having an outlet, in combination with an apparatus for charging a flat coiler can with sliver; said apparatus being disposed at said outlet and comprising:

a rotary coiler head receiving sliver from said outlet and depositing the sliver in coils in the coiler can;

means for reciprocating the coiler can underneath said coiler head in a first direction for depositing sliver along a coiler can length extending parallel to said first direction;

means for shifting said coiler head in a second direction over an additional coiler can for switching coiler cans from a full can to an empty can; and slack forming means for forming a slack in the sliver between said outlet of said carding machine and said coiler head, wherein the slack forming means forms the slack in the sliver such that the entire slack sliver is suspended by ends of the slack sliver.

2. The combination as defined in claim 1, wherein said outlet of said carding machine comprises a calender roll pair; further wherein said slack forming means comprises said calender roll pair and a deflecting roller positioned between said calender roll pair and said coiler head; said deflecting roller supporting the sliver as the sliver runs from said calender roll pair to said coiler head.

3. The combination as defined in claim 1, further comprising a drafting unit disposed between said slack forming means and said coiler head.

4. The combination as defined in claim 3, further comprising means for regulating said drafting unit.

5. The combination as defined in claim 1, further comprising a sliver-deflecting roller disposed between said slack forming means and said coiler head.

6. The combination as defined in claim 5, further comprising a drafting unit disposed between said slack forming means and said coiler head, and wherein said sliver-deflecting roller is disposed between said slack forming means and said inlet of said drafting unit.

7. The combination as defined in claim 1, further comprising control means for controlling an extent of sliver slack.

8. The combination as defined in claim 7, wherein said control means comprises a sensor for detecting the extent of sliver slack.

9. The combination as defined in claim 8, wherein said sensor comprises an optical barrier.

10. A method of charging flat coiler cans with sliver outputted by a carding machine; the method comprising the following cyclical steps:

(a) introducing sliver into a rotary coiler head from the carding machine;

(b) depositing, by the rotating coiler head, sliver in coils in a first coiler can;

(c) reciprocating the first coiler can underneath said coiler head in a first direction for depositing sliver along a coiler can length extending parallel to said first direction;

(d) forming a slack in the sliver between an outlet of said carding machine and said coiler head;

(e) when charging the first coiler can with sliver is concluded, shifting said coiler head in a second direction from above said first coiler can over a second coiler can;

(f) upon completion of step (e), depositing sliver in the second coiler can situated adjacent said first coiler can; and (g) after completion of step (e), replacing said first coiler can with a third coiler can, wherein the slack is formed in the sliver such that the entire slack sliver is suspended by ends of the slack sliver.

11. The method as defined in claim 10, wherein step (g) is performed parallel to said first direction.

* * * * *